United States Patent [19]

Will

[11] 4,409,969

[45] Oct. 18, 1983

[54] DEVICE FOR TREATING FAULTY POSITIONS AND POSTURES OF THE HUMAN TORSO

[76] Inventor: Peter Will, Wienerstrasse 78, 6100 Darmstadt, Fed. Rep. of Germany

[21] Appl. No.: 177,773

[22] Filed: Aug. 13, 1980

[30] Foreign Application Priority Data

Aug. 14, 1979 [DE] Fed. Rep. of Germany ..... 2932881

[51] Int. Cl.[3] ..... A61F 5/02

[52] U.S. Cl. ..... 128/78; 272/143

[58] Field of Search ..... 128/78, 75, 83, 84 R, 128/85, 69; 272/143, DIG. 5

[56] References Cited

U.S. PATENT DOCUMENTS

| | | | |
|---|---|---|---|
| 330,094 | 11/1885 | Carroll et al. | 128/78 |
| 1,275,522 | 8/1918 | Boylan | 272/143 X |
| 1,647,299 | 11/1927 | Konig | 272/143 X |
| 2,940,442 | 6/1960 | Wilhelm | 128/75 |
| 3,889,664 | 6/1975 | Heuser et al. | 128/78 |

FOREIGN PATENT DOCUMENTS

| | | | |
|---|---|---|---|
| 2536560 | 10/1977 | Fed. Rep. of Germany . | |
| 131172 | 3/1951 | Sweden | 128/78 |

*Primary Examiner*—Richard C. Pinkham
*Assistant Examiner*—T. Brown

[57] ABSTRACT

A device for treating faulty positions and postures of the human torso by means of at least one lockable force storing mechanism inserted into strapping lying against the body and having a locking element so coupled with a strap mounting element displaceable relative to the casing of the storage mechanism and biased towards a starting position, of a tension strap transmitting postural changes of torso to the force storage mechanism that the strap mounting element in the period of time of the desired postural correction blocks the force storage mechanism when the tension strap is held substantially free of tension. At least one measuring strap or Bowden cable is connected to the strapping and to the force storage mechanism. This strap or Bowden cable upon the assumption of faulty posture of the torso releases the locking of the force storage mechanism whereby the tension strap is effectively tensed with intensified pull in the direction of the faulty posture and remains tense until, by a postural correction of the wearer acting against the spring tension of the force storage mechanism the locking element locks the strap mounting while the strap is again free of tension.

8 Claims, 5 Drawing Figures

DEVICE FOR TREATING FAULTY POSITIONS AND POSTURES OF THE HUMAN TORSO

The invention relates to a device for treating faulty positions and postures of the human torso by means of at least one lockable force storage means which is or are inserted into a strapping system engaging the body. Such a device can serve, for example, as an activating brace for the control of torso posture.

Skeletal deformities, faulty posture of the motor apparatus, muscular insufficiencies and the like require, particularly in young people, a regular, sufficiently intensive exercise therapy. Particularly important is early treatment in the case of spinal damage to young people and of misalignments of the skeletal structure of the shoulder, which can be undertaken successfully under certain circumstances by appropriate therapeutic efforts before statural growth is completed. An important requirement for this is regular performance for years. Unfortunately, experience shows that various factors and circumstances reduce the effectiveness, especially of active exercise therapy. In addition to lack of understanding and cooperation on the part of the patient, it is often the lack of time, inconvenient location of [the patient's] residence for ambulatory treatment and general inconvenience that make the outcome of the treatment doubtful. Methods of treatment are sought which will be self-sustaining or which, in combination with the former measures, will make provision for the above-described obstacles and for human inertia, and at the same time will assure a very intensive active exercise therapy.

In German Pat. No. 2,536,560 there is described a training device in which two force storage means are coupled together such that, during the tightening, e.g., during a corrective movement erecting the torso, in which both of the shoulder straps are moved backward, by means of straps applied to the patient, one of the force storage means is locked in its backward movement while the other remains in effect. This locking is released again by the movement of the other storage means when, upon the neglect of the correct posture of the torso involving a forward displacement of the shoulder straps, its tension force drops below a given value. The released force thus produces a perceptible loading of the shoulder straps through the [other] straps, so that in this manner the patient is made aware of the postural error and is given an inducement to perform another correction.

In the above-mentioned device of German Pat. No. 2,536,560, what is involved is exclusively a training device which can be used for temporary exercise. This device is not suited for the continuous control and correction of torso posture, because, according to the stated objective of the invention, a constant tension is maintained by the applied belts, which is intensified upon a change of posture and is not tolerated for a long period of time. Therefore, the device can not be used for the continuous controlling of normal posture.

On the other hand, the invention is based on the object of creating a device for the treatment of faulty positions and postures of the human torso, which is simple in its mechanism and causes very little trouble to the wearer.

This object is achieved by the invention by the fact that the locking means of the force storage means is coupled to a strap holding means of a tension strap transmitting postural changes to a force storage means, which strap holding means is displaceable relative to the casing of the force storage means and is biased to a starting position, such that the strap holding means locks the force storage means when the tension strap is substantially tension-free, for a period of time of a desired postural correction (prescribed or normal posture), and that at least one measuring strap or Bowden cable connected to the strapping on the one hand and to the force storage means on the other is provided, which, when the torso assumes a faulty posture, releases the lock of the force storage means, whereupon the tension strap is effectively tensed with an intensified pull in the direction of the faulty posture and remains tensed until a postural correction by the wearer acting against the spring tension of the force storage means enables the locking means to lock the strap holding means with the strap again tension-free. In the invention, the force storage means therefore is locked in its end position against its return by an active, predetermined movement which is picked up by the tension strap. This lock is then again released by the measuring strap or Bowden cable whenever the posture exceeds a predetermined deviation from the required or normal posture.

Substantially two phases of movement of the body members involved are the basis for the control of posture by the device of the invention. In the first phase, a perceptible stressing of selective muscle groups or functional systems of the motor apparatus is brought about by a controllable, externally acting force. After a certain active movement of the body members of predetermined extent, or after an isotonic muscle contraction against the externally acting force, the latter vanishes as soon as the mechanical locking means responds. The trainee now feels himself free of the previously exercised stress.

In the second phase of the training process, the attained goal of movement or the accomplished correction of a faulty posture is to be maintained active. In the event of a definitely flagging muscle action or definite loss of the correction of the faulty posture beyond a predetermined measure, the stressing of the muscles or of the functional systems is reactivated and made definitely perceptible by means of the mechanism of the device by the removal of the lock or release of the locking, so that the trainee is again recalled to the desired muscle activity and correction of poor posture.

It is desirable that the distance which the tension strap must move until lock-up occurs and the distance which the measuring strap or Bowden cable must move in order to release the lock be predeterminable. Furthermore, it is desirable to make the initial force of the storage means adjustable by varying the bias of its spring.

Advantageous embodiments and further developments of the invention are the subject of the subordinate claims.

The invention is further explained hereinbelow in conjunction with the drawing, and indeed:

The invention proposes for the force storage means the use of mechanical springs which can act on the body members through tension members such as belts.

Figure 1:
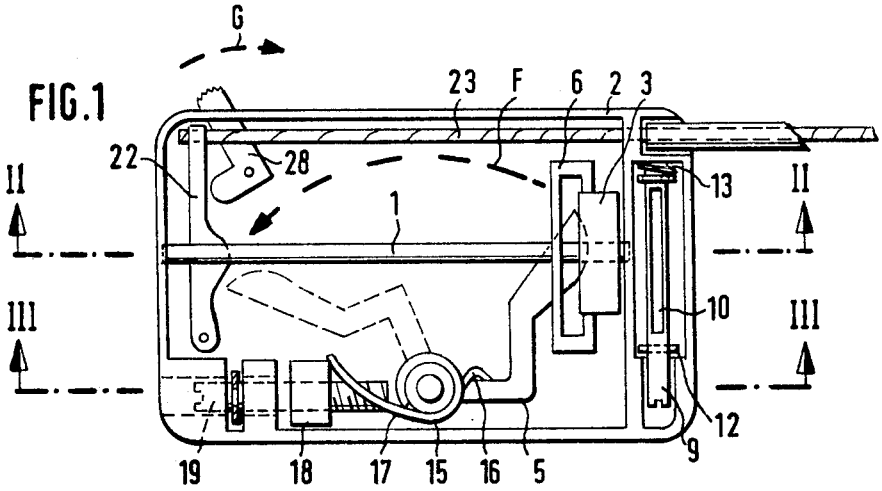
FIG. 1 shows a top view of an embodiment of the device of the invention with the casing open.
Figure 2:
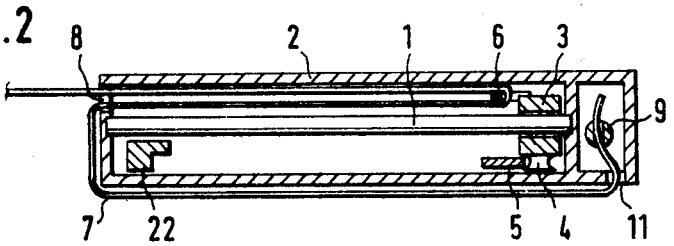
FIG. 2 shows a cross-section through the device along the line II—II of FIG. 1.
Figure 3:
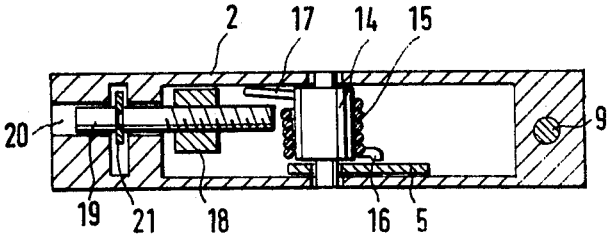
FIG. 3 shows a cross-section through the device along the line III—III in FIG. 1, and FIGS. 4 and 5 are a diagrammatic representation of two views of the arrangement of the device of the invention in a typical application.

One possible embodiment is shown in FIG. 1. A small slide 3 rides on a guide rod 1 having a polygonal profile or round cross section, which is fastened at both its ends to the casing 2 of the device. The slide 3, which, as seen in FIG. 2, lies flat against the bottom of the casing, has on this side a cylindrical projection or a rotatable wheel having a circumferential groove 4 for guiding a tension lever 5. The slide 3 is equipped with a stirrup 6 which serves as a guide for a tension strap 7 which is carried through a casing slit 8 and is looped about stirrup 6 and brought back out through the slit 8. For the taking up of the tension strap 7, whose one end rides on the outside of the bottom of the casing, a shaft 9 is provided in the casing 2 as a winding means. The end of the strap is introduced into a slit 11 in the casing and is accommodated in a longitudinal slot 10 in the shaft 9. The shaft is prevented from slipping out of its bearings by a pin 12 in the shaft 9 and at the same time produces a necessary friction by the thrust of the projecting ends of the pin to prevent any unintended rotation of the shaft. A disk spring 13 provides for the necessary bearing pressure of the pin 12.

The tension lever 5 is mounted on a pivot shaft 14 fastened in the casing. A torsion coil spring 15 is disposed on the shaft 14 such that the one spring arm 16 engages the tension lever 5 and the other spring arm 17 is biased against an adjusting nut 18. By the rotation of a threaded spindle 19, which is held in a bore 20 of the casing 2 and is prevented from axial displacement by a retaining ring 21, the adjusting nut 18, whose one surface engages the casing, can be displaced along the threaded spindle 19 and thus the bias of the spring 15 can be varied through the spring arm 17.

The slide 3, when guided on the rod 1 all the way to its left end position, will there lie against a return lever 22 to which a cord or Bowden cable 23 is fastened. At the same time, the tension lever 5 will have been swung, with tensing of the torsion spring 15, to the position shown in broken lines (along the arrow F), in which its head lies no longer in front of but below the guide wheel groove 4, and consequently exerts no return force on the slide 3. By means of the return lever 22, the slide is shifted back from its dead or end position toward the starting position against the pressure and friction of the tension lever 5. By means of a locking lever 28, whose one end is carried out through the lateral casing wall, the return lever 22 can be locked by manually shifting the locking lever in the direction of the arrow G.

Figure 4:
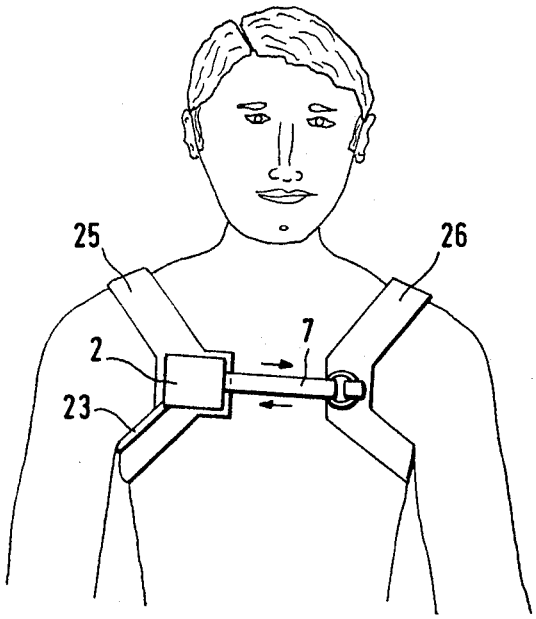
Figure 5:
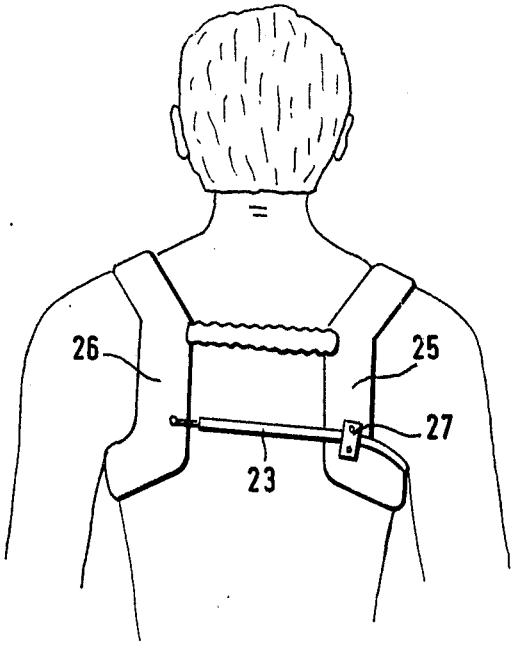

FIGS. 4 and 5 show an application of the therapeutic device of the invention. It can be seen in FIG. 4 that the device can be fastened on the breast side to a shoulder strap on the [wearer's] right side, while the tension strap is fastened to a shoulder strap 26 applied to the opposite shoulder. The Bowden cable 23 runs from the casing 2 under the armpit along the shoulder strap to the back, and from there, as shown in FIG. 5, to the opposite shoulder strap 26, and here it is fastened to hooks or buttons according to the required length and the desired freedom of movement.

In the application of the device, after the shoulder straps 25 and 26 have been applied, first the desired length of the tension strap 7 is determined by the winding means. At the same time the latter can also be used to determine the necessary movement of the torsion spring 15, since the other end of strap 7 is fastened to the shoulder strap 26. An individual adaptation of the bias of the spring 15 is established by means of the threaded spindle 19.

When the shoulder strap is displaced rearwardly, the slide 3 is moved leftward along the guide rod 1 (FIG. 1) by the tension strap 7 which is doubled back along the guide rod, while at the same time the torsion spring 15 is tensed by the tension lever 5. If the length to which the strap is pulled out by the backward movement of the shoulder straps is so adjusted that, in the end phase of this movement, the slide 3 is in its end position, a lock-up occurs, because the slide 3 brings the tension lever into the turned position represented in broken lines in FIG. 1, in which position the direction of the force of the torsion spring 15 is deflected to a direction largely at right angles to the direction of movement of the slide 3 on the rod 1. Therefore, a component of force seeking to push the slide back to the starting position is not produced, so that the slide in this position does not exercise any tension force on the tension strap 7. The friction prevailing between the tension lever 5 and the guiding groove prevents any spontaneous displacement of the slide on the guide rod.

If the correctness of posture achieved by the rearward movement of the shoulder strap is neglected and the shoulder straps are again shifted forward, the increase in the distance between the straps on the back (FIG. 5) produces the result that the Bowden cable 23 whose core is fastened to the strap 26 and whose sheath is fastened by the clamp 27 to the strap 25 transmits this posture change to the return lever 22, which in turn pushes the slide 3, which is in its end position, in the direction of the starting position to such an extent that the tension lever 5 becomes active again. The force stored in the spring 15 then by means of a rocking movement of the tension lever 5 pushes the slide 3 towards its starting position, bringing about a shortening of the strap extension and the spring force acts perceptibly on the shoulder strap in its bias through the straps 25 and 26. The breastward tension thus again produced makes the wearer conscious of his return to his faulty posture, so that he is induced to correct it again.

If the action of the spring on the shoulder straps is not desired for a brief period, the return lever 22 can be locked by the locking lever 28 after a correcting movement of the shoulder straps, so that a change of posture can no longer be transmitted through the Bowden cable 23.

The arrangement of the torsion spring coupled with the self-locking tension lever 5 offers special advantages, because in the initial phase of the tensing process, with short pull, on account of the counter-pressure acting in the direction of movement (along the guide rod 1), a larger expenditure of effort is required of the wearer than in the final phase of the tensing process, in which, with a longer pull and increasing deflection of the direction of force, a lesser expenditure of effort is necessary. This feature is to the benefit of the expenditure of effort of the shoulder straps in the rearward process of movement, because in the initial phase of the movement, a greater development of force is possible due to anatomical circumstances of the shoulder straps than in the final phase of the movement.

In comparison with a detent for the tension lever 5, which basically could also be used, and which is linked to the Bowden cable 23, and releases the tension lever again after a certain slack movement, this arrangement furthermore has the advantage that the returning tension force occurs not abruptly, but increases gradually, without the need for damping elements.

An additional possibility of application is to be found in the case of faulty posture of the torso combined with considerable weakness of the abdominal muscles. In this case an elastic strap laid about the abdomen, with its ends joined by a tension spring under bias, is coupled to the Bowden cable 23 such that its increase in width is transmitted to the cable as a tension effect. The tension and locking of the force storage means achieved by a shoulder strap movement, as explained, is relieved by the Bowden cable 23 when the abdominal muscle tension is relaxed with the belly drawn in and the torso straightened up, and the forward-shifting abdominal wall produces an extension of the abdominal strap.

Various modifications or further developments are possible in the construction of the therapeutic device of the invention. Thus, instead of the torsion spring 15, one or more compression or tension springs are used as force storage means, the direction of the force on a displaceable member, such as the slide 3, being varied by a lever in relation to movement during the tension. Instead of the guide rod 1, there are other possibilities for guiding the slide 3, such as, say, a groove-like recess in the casing cover or bottom.

The device of the invention permits both an active correction of faulty posture of the torso and an exercise therapy of the muscles of the torso. The particular tensing of the force storage means over the given pull length with the tension of the springs selectively adjusted after neglect of the desired body posture brings about an ever recurring activation both of the shoulder straps and also of the torso muscles and enables the wearer to be made conscious of his faulty posture and of the correct torso posture.

I claim:

1. A device for treating faulty positions of the torso of a person, comprising: in a housing at least one force storage means and means for mounting a tension strap; said tension strap mounting means being movable in said housing between an end position and a starting position; said force storage means biasing said mounting means for movement from said end position to said starting position; locking means for locking said mounting means in said end position; strap means for mounting said housing to the torso of a person to be treated; a tension strap connected to said mounting means and to said strap means such that, upon the person correcting his or her posture from a faulty position to a desired position, said tension strap moves said mounting means into said end position and the latter is locked by said locking means; and means connected to said strap means for releasing said locking means and thereby said mounting means upon change of the person's posture from said desired position to a faulty position.

2. Treatment device of claim 1, wherein the force storage means has a spring and said mounting means is a slide which is engaged by the tension strap, and a tension lever pivotally mounted in said housing and engaging said slide being biased by said spring, said tension lever being rotatable about an axis of rotation which is disposed with reference to where said tension lever engages said slide such that the component of its counter-pressure on the slide acting in the direction of slide displacement decreases to zero in the end position of the slide.

3. Treatment device of claim 2, wherein the releasing means comprises a return lever which comes in contact with the slide in the end position of the slide and in a swinging movement pushes the slide out of the end position in the direction of its starting position.

4. Treatment device of claim 1 or 2, comprising an adjusting member, and wherein the initial value of the tension force of the force storage means is adjustable by varying the bias of said spring by means of said adjusting member.

5. Treatment device of claim 4, comprising an adjustment nut rotatably mounted on a threaded spindle, wherein the spring is a torsion coil spring disposed on the axis of rotation of the tension lever, said coil spring having a first arm engaging the tension lever and a second arm which lies against said adjusting nut which in turn is adjustable by means of said threaded spindle.

6. Treatment device of claim 1 or 2, comprising a stirrup joined with the slide, and wherein the tension strap is carried in a loop through said stirrup, and winding means for adjusting the length of said tension strap.

7. A device according to claim 1, wherein said releasing means is a Bowden cable.

8. A device according to claim 1, wherein the distances moved by said tension strap and said releasing means before locking and release are effected respectively, are predeterminable.

* * * * *